United States Patent [19]

Burmeister et al.

[11] Patent Number: 4,786,263

[45] Date of Patent: Nov. 22, 1988

[54] MARINE PROPULSION DEVICE POWER TILT AND TRIM MECHANISM

[75] Inventors: Scott N. Burmeister, Gurnee; Roger B. Whipple, Waukegan; Martin J. Mondek, Wonder Lake; Duane W. Harris, Lake Villa, all of Ill.

[73] Assignee: Outboard Marine Corporation, Waukegan, Ill.

[21] Appl. No.: 103,507

[22] Filed: Oct. 1, 1987

[51] Int. Cl.[4] ..... B63H 21/26

[52] U.S. Cl. ..... 440/53; 440/61

[58] Field of Search ..... 440/53, 61, 900, 63; 248/640, 641, 642, 643

[56] References Cited

U.S. PATENT DOCUMENTS

| | | | |
|---|---|---|---|
| 2,953,335 | 9/1960 | Kiekhaefer | 440/61 |
| 3,003,724 | 10/1961 | Kiekhaefer | 248/4 |
| 3,434,450 | 3/1969 | McCormick | 115/41 |
| 3,473,325 | 10/1969 | Vargo | 60/52 |
| 3,581,702 | 6/1971 | Moberg | 115/41 |
| 4,232,627 | 11/1980 | Glenn et al. | 440/61 |
| 4,325,700 | 4/1982 | Kern et al. | 440/61 |
| 4,482,330 | 11/1984 | Cook | 440/2 |
| 4,687,448 | 8/1987 | Peirce | 440/53 |

FOREIGN PATENT DOCUMENTS

| | | | |
|---|---|---|---|
| 234094 | 11/1985 | Japan | 440/61 |

*Primary Examiner*—Sherman D. Basinger
*Assistant Examiner*—Stephen P. Avila
*Attorney, Agent, or Firm*—Michael, Best & Freidrich

[57] ABSTRACT

An assembly for mounting a marine propulsion unit on the transom of a boat, the assembly comprising a transom bracket adapted to be fixedly mounted on the transom, the transom bracket having mounted thereon a tilt pin and including bores permitting selective location of the tilt pin in a plurality of fixed positions relative to the transom bracket, a swivel bracket mounted on the transom bracket for pivotal movement relative thereto about a generally horizontal tilt axis, an extendible and contractable linkage having a first end pivotally connected to the tilt pin and a second end pivotally connected to the swivel bracket, and a mechanism for selectively and alternatively extending and contracting the linkage for moving the swivel bracket between an operating position and a raised position.

14 Claims, 2 Drawing Sheets

MARINE PROPULSION DEVICE POWER TILT AND TRIM MECHANISM

BACKGROUND OF THE INVENTION

The invention relates to marine propulsion device power tilt and trim mechanisms. and, more particularly, to hydraulic power tilt and trim mechanisms for outboard motors It is known to locate a power tilting mechanism for an outboard motor between the transom and the swivel bracket with the mechanism having one end pivotally connected to the transom bracket and a second end pivotally connected to the swivel bracket. See, for example, Japanese Kokai No. 60-1097, published Jan. 7, 1985.

It is also known to use a pin extending through the transom bracket to determine the operating position or trim of an outboard motor. The pin limits downward pivotal movement of the swivel bracket and of the propulsion unit about the tilt axis. Typically, the pin can be located in a plurality of positions.

Attention is directed to the following U.S. Pat. Nos.:

| U.S. patents: | | |
|---|---|---|
| Moberg | 3,581,702 | June 1, 1971 |
| Cook | 4,482,330 | Nov. 13, 1984 |
| Glenn et al. | 4,232,627 | Nov. 11, 1980 |
| McCormick | 3,434,450 | March 25, 1969 |
| Kiekhaefer | 3,003,724 | Oct. 10, 1961 |
| Vargo | 3,473,325 | Oct 21, 1969 |
| Kern et al. | 4,325,700 | Apr. 20, 1982 |

SUMMARY OF THE INVENTION

The invention provides a marine propulsion device comprising a transom bracket adapted to be fixedly mounted on the transom of a boat, the transom bracket having mounted thereon a tilt pin and including means permitting selective location of the tilt pin in a plurality of fixed positions relative to the transom bracket, and a swivel bracket mounted on the transom bracket for pivotal movement relative thereto about a generally horizontal tilt axis. The marine propulsion device also comprises an extendible and contractable linkage having a first end pivotally connected to the tilt pin and a second end pivotally connected to the swivel bracket, means for selectively and alternatively extending and contracting the linkage, and a propulsion unit mounted on the swivel bracket for pivotal movement relative thereto about a generally vertical steering axis, and for common movement therewith about the tilt axis, the propulsion unit including a rotatably mounted propeller, and a power head drivingly connected to the propeller.

In one embodiment, the swivel bracket is movable between an operating position and a raised position, and extension of the linkage moves the swivel bracket toward the raised position and contraction of the linkage moves the swivel bracket toward the operating position.

In one embodiment, the means permitting selective location of the tilt pin includes means defining a plurality of passages extending through the transom bracket and having spaced, generally horizontal axes.

In one embodiment, the transom bracket includes a pair of horizontally spaced apart members extending generally vertically adjacent the transom and having upper and lower ends, the tilt axis is located adjacent the upper ends, the tilt pin is located adjacent the lower ends and extends between the members, and the linkage is located between the members and between the transom and the swivel bracket.

In one embodiment, the means for extending and contracting the linkage is also located between the members and between the transom and the swivel bracket.

In one embodiment, the linkage includes a hydraulic cylinder and piston assembly, and the means for extending and contracting the linkage includes means for supplying fluid to the hydraulic cylinder and piston assembly.

The invention also provides an assembly for mounting a marine propulsion unit on the transom of a boat, the assembly comprising a transom bracket adapted to be fixedly mounted on the transom, the transom bracket having mounted thereon a tilt pin and including means permitting selective location of the tilt pin in a plurality of fixed positions relative to the transom bracket and a swivel bracket mounted on the transom bracket for pivotal movement relative thereto about a generally horizontal tilt axis. The assembly also comprises an extendible and contractable linkage having a first end pivotally connected to the tilt pin and a second end pivotally connected to the swivel bracket, and means for selectively and alternatively extending and contracting the linkage.

A principal feature of the invention is the provision of a power tilting mechanism pivotally connected to the transom bracket by a tilt pin which can be selectively located in a plurality of positions relative to the transom bracket. Because the location of the tilt pin relative to the transom bracket determines the location of the hydraulic assembly relative to the transom bracket, and this in turn determines the location of the swivel bracket relative to the transom bracket, this feature permits selective variation of the trim or the location of the operating position of the propulsion unit.

Another principal feature of the invention is the provision of a power tilting mechanism which can be readily fitted on a conventional outboard motor. The power tilting mechanism is fitted by pivotally connecting one end of the hydraulic assembly to the swivel bracket and the other end of the hydraulic assembly to the tilt pin. The entire mechanism fits between the arms of the transom bracket and between the transom and the swivel bracket.

Other principal features and advantages of the invention will become apparent to those skilled in the art upon review of the following detailed description, claims and drawings.

Figure 1:
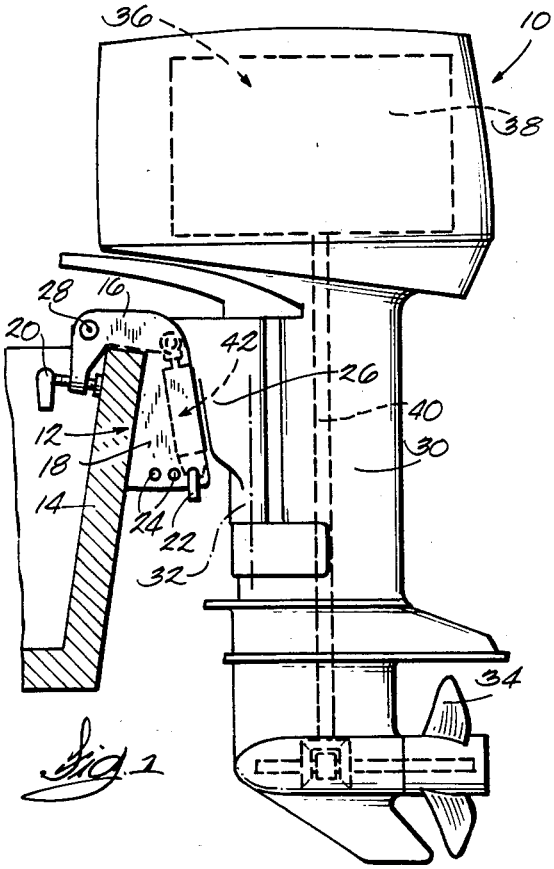
FIG. 1 is a side elevational view of a marine propulsion device including a power tilting mechanism embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded a limiting.

DESCRIPTION OF THE PREFERRED EMBODIMENT

Figure 2:
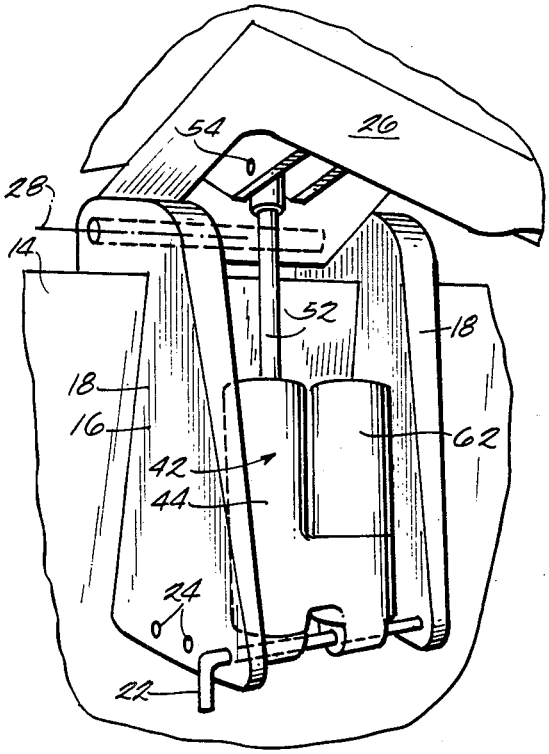
FIG. 2 is a perspective view of the power tilting mechanism.

A marine propulsion device 10 embodying the invention is illustrated in the drawings. As best shown in FIGS. 1 and 2, the marine propulsion device 10 comprises a mounting assembly 12 mounted on the transom 14 of a boat.

While various suitable mounting assemblies can be employed, in the preferred embodiment, the mounting assembly 12 includes a transom bracket 16 fixedly mounted on the transom 14. In the illustrated construction, the transom bracket 16 includes a pair of horizontally spaced apart, U-shaped members 18 extending generally vertically adjacent or over the transom 14 and having upper and lower ends. Conventional screw clamps 20 secure the members 18 to the transom. Each of the members 18 has a forward arm extending forwardly of the transom 14 and having therethrough one of the screw clamps 20, and a rearward arm extending rearwardly of the transom 14.

The transom bracket 16 has mounted thereon a tilt pin 22, and the transom bracket 16 includes means permitting selective location of the tilt pin 22 in a plurality of fixed positions relative to the transom bracket 16. While various suitable means can be employed, in the preferred embodiment, the means permitting selective location of the tilt pin 22 includes means defining a plurality of passages extending through the transom bracket 16 and having spaced, generally horizontal axes. Preferably, the passage defining means includes a plurality of pairs of aligned bores 24 in the rearward arms of the transom bracket members 18. The bores 24 are arranged in an arcuate pattern and are located adjacent the lower ends of the rearward arms of the transom bracket members 18, i.e., adjacent the lower ends of the transom bracket members 18. This construction is known in the art and need not be explained in further detail The mounting assembly 12 also includes a swivel bracket 26 mounted on the transom bracket 16 for Pivotal movement relative thereto about a generally horizontal tilt axis 28. The swivel bracket 26 is movable about the tilt axis 28 between an operating or lower position (FIG. 1) and a raised or upper position (FIG. 2) angularly displaced from the operating position.

The marine propulsion device 10 also comprises a propulsion unit 30 mounted on the swivel bracket 26 for pivotal movement relative thereto about a generally vertical steering axis 32, and for common movement therewith about the tilt axis 28. The propulsion unit 30 includes a rotatably mounted propeller 34, and a power head 36 drivingly connected to the propeller 34. In the preferred embodiment, the power head 36 includes an internal combustion engine 38 drivingly connected to the propeller 34 by a conventional drive train 40.

The marine propulsion device 10 also comprises an extendible and contractable linkage 42 having a first or lower end pivotally connected to the tilt pin 22 and a second or upper end pivotally connected to the swivel bracket 26. In the preferred embodiment, extension of the linkage 42 moves the swivel bracket 26 upwardly or toward the raised position, and contraction of the linkage 42 moves the swivel bracket 26 downwardly or toward the operating position. Furthermore, in the preferred embodiment, the linkage 42 is located between the transom bracket While various suitable linkages can be used, in the illustrated construction, the linkage 42 includes a hydraulic cylinder and piston assembly. The hydraulic assembly includes (see FIG. 3) a cylinder 44 having a lower end pivotally connected to the tilt pin 22, and an upper end. The hydraulic assembly also includes a piston 46 slidably received within the cylinder 44 and dividing the cylinder into an upper chamber 48 and a lower chamber 50. The hydraulic assembly further includes a piston rod 52 extending through the upper end of the cylinder 44 and having an upper end pivotally connected to the swivel bracket 26, and a lower end fixedly connected to the piston 46 for movement therewith. In the illustrated construction, the upper end of the piston rod 52 is pivotally connected to the swivel bracket 26 by a pin 54 (FIG. 2).

Figure 4:
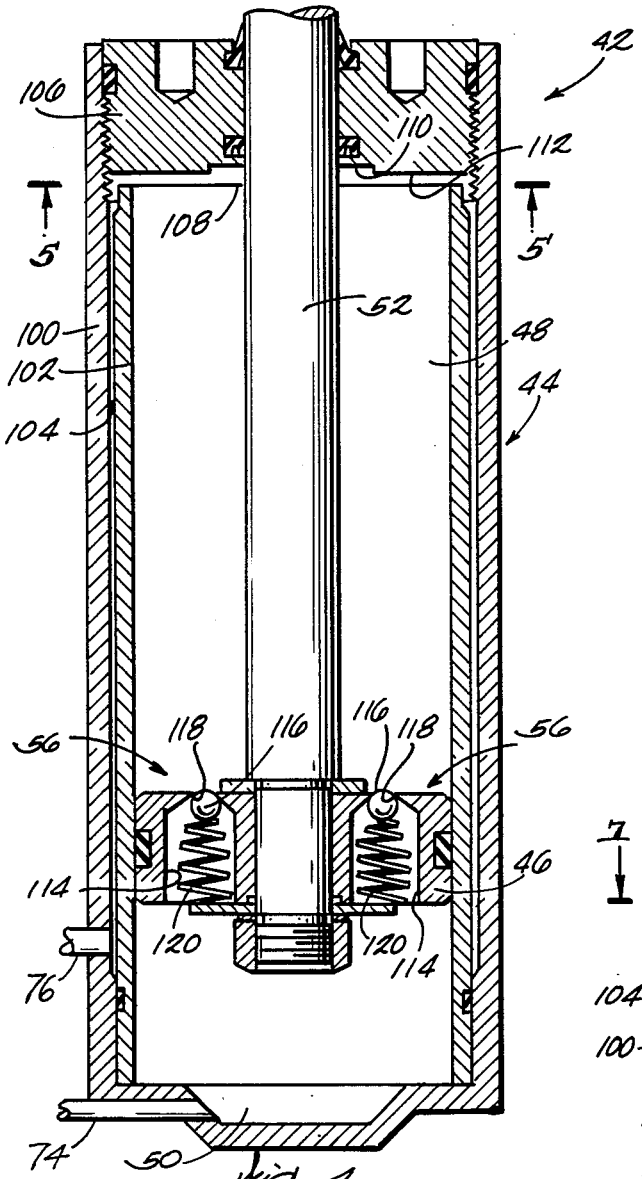
FIG. 4 is a view, partially in section, of the cylinder.
Figure 5:
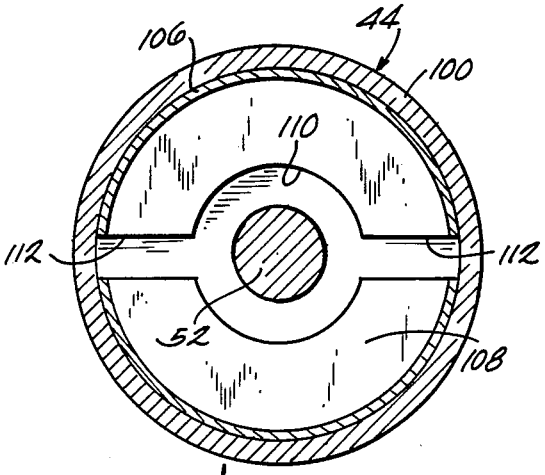
FIG. 5 is a view taken along line 5—5 in FIG. 4.

More particularly, as shown in FIG. 4, the cylinder 44 includes an outer wall 100, and an inner sleeve 102 mounted inside the outer wall 100 to define an annular space 104 between the outer wall 100 and the inner sleeve 102. The interior of the inner sleeve 102 defines the upper and lower cylinder chambers 48 and 50, respectively, and the piston 46 is slidably mounted within the inner sleeve 102. The cylinder 44 also includes a cap 106 threaded into the upper end of the outer wall 100 and including a lower surface 108 engaging the upper end of the inner sleeve 102. The lower surface 108 of the cap 106 has therein (see FIGS. 4 and 5) an annular recess 110 surrounding the piston rod 52, and a pair of recesses 112 extending radially from the annular recess 110 to the radially outer edge of the cap 106. As shown in FIG. 4, the upper cylinder chamber 48 communicates with the space 104 via the radial recesses 112.

In order to permit upward tilting movement of the propulsion unit 30 in the event the propulsion unit 30 strikes an underwater obstruction, the piston 46 has therein (see FIG. 3) a number of impact relief valves 56. In the preferred embodiment, the piston 46 has therein six relief valves 56. Each relief valve 56 includes a passage 114 extending through the piston 46, and a ball 116 within the passage 114. The passage 114 has an upper end with a diameter less than the diameter of the ball 116 so as to form a valve seat 118. Each valve 56 also includes a spring 120 biasing the ball 116 upwardly against the valve seat 118. When the ball 116 is seated, a portion of the ball 116 extends above the upper surface of the piston 46.

When the propulsion unit 30 strikes an underwater obstruction, the upward tilting force exerted on the propulsion unit 30 increases the pressure in the upper cylinder chamber 48. When this pressure exceeds a predetermined level, the impact relief valves 56 open and permit fluid flow from the upper chamber 48 to the lower chamber 50, thereby permitting the piston 46 to move upwardly within the cylinder 44. This extends the piston rod 52 and permits the propulsion unit 30 to tilt upwardly.

The marine propulsion device 10 further comprises means for selectively and alternatively extending and contracting the linkage 42 for moving the swivel bracket 26 between the operating position and the raised position In the preferred embodiment, wherein the linkage 42 includes the hydraulic assembly, the means for extending and contracting the linkage 42 includes means for supplying hydraulic fluid to the hydraulic assembly. More particularly, the extending and contracting means includes means for selectively and alternatively supplying hydraulic fluid to the upper and lower chambers 48 and 50 of the cylinder 44.

Figure 3:
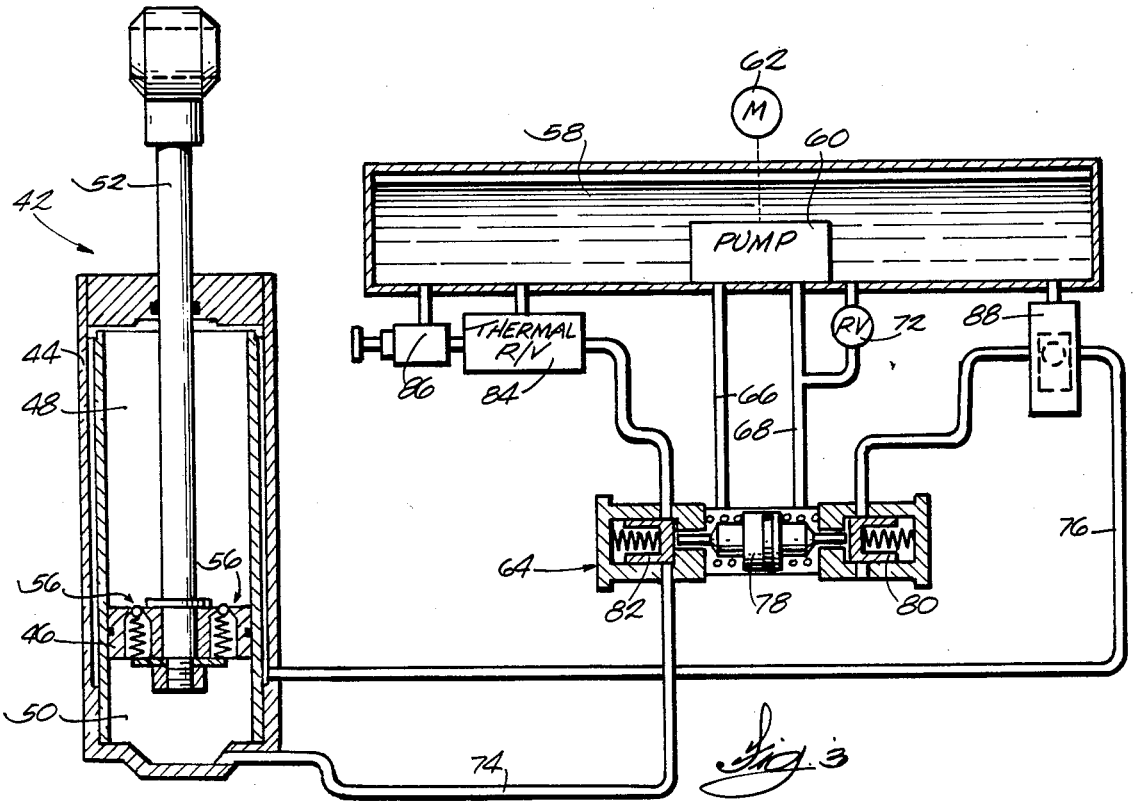
FIG. 3 is a schematic view of the power tilting mechanism.

As is apparent from viewing FIG. 3, supplying hydraulic fluid to the lower chamber 50 causes extension of the piston rod 52 and upward tilting movement of the swivel bracket 26 and propulsion unit 30, and supplying hydraulic fluid to the upper chamber 48 causes retraction of the piston rod 52 and downward tilting movement of the swivel bracket 26 and propulsion unit 30.

While various suitable supply means can be employed, in the preferred embodiment, the supply means includes a fluid reservoir 58 (FIG. 3) and a reversible pump 60. Operation of the pump 60 is controlled by a drive motor 62 (FIGS. 2 and 3), preferably a reversible DC motor. The motor 62 can be controlled by any suitable operator actuated means.

The pump 60 is connected to the cylinder 44 by a hydraulic circuit. As shown in FIG. 3, the hydraulic circuit includes a shuttle piston valve 64 having left and right ends. The valve 64 is conventional and will be described only to the extent necessary to understand the operation of the hydraulic circuit. The valve 64 includes a shuttle piston 78, a right check valve 80, and a left check valve 82

The hydraulic circuit also includes a first passageway 66 communicating between the pump 60 and the left end of the valve 64, and a second passageway 68 communicating between the pump 60 and the right end of the valve 64. A conventional relief valve 70 communicates between the first passageway 66 and the reservoir 58, and a conventional relief valve 72 communicates between the second passageway 68 and the reservoir 58. The hydraulic circuit also includes a third passageway 74 communicating between the left end of the valve 64 and the lower cylinder chamber 50, and a fourth passageway 76 communicating between the right end of the valve 64 and the upper cylinder chamber 48 via the space 104.

When the motor 62 is actuated to drive the pump 60 in the forward direction, fluid is pumped to the left side (as shown in FIG. 3) of the shuttle piston 78 via the first passageway 66. This fluid moves the shuttle piston 78 to the right, thereby opening the right check valve 80 and causing communication between the second passageway 68 and the fourth passageway 76. At the same time, the pressure of the fluid on the left side of the shuttle piston 78 opens the left check valve 82. This causes communication between the first passageway 66 and the third passageway 74 and permits the fluid to flow into the lower cylinder chamber 50, thereby causing the piston 46 to move upwardly. Upward movement of the piston 46 causes fluid to flow out of the upper cylinder chamber 48 and return to the reservoir via the fourth and second passageways 76 and 68, respectively.

When the motor 62 is actuated to drive the pump 60 in the reverse direction, fluid is pumped to the right side of the shuttle piston 78 via the second passageway 68, the shuttle piston 78 moves to the left, fluid flows from the pump 60 to the upper cylinder chamber 48 via the second and fourth passageways 68 and 76, respectively, and fluid flows from the lower cylinder chamber 50 to the reservoir 58 via the third and first passageways 74 and 66, respectively. The relief valve 72 opens if the piston 46 bottoms out.

Figure 7:
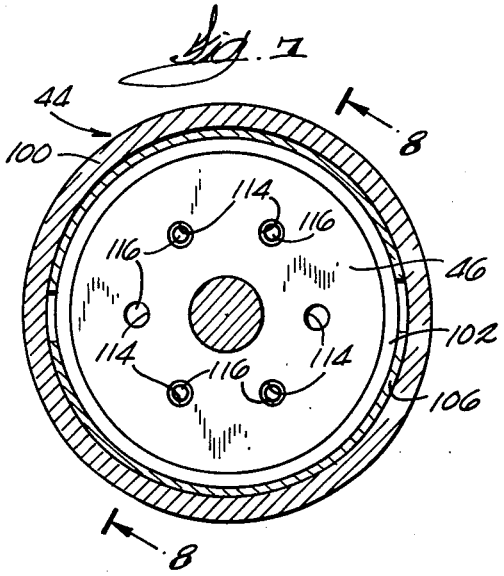
FIG. 7 is a view taken along line 7—7 in FIG. 6.
Figure 6:
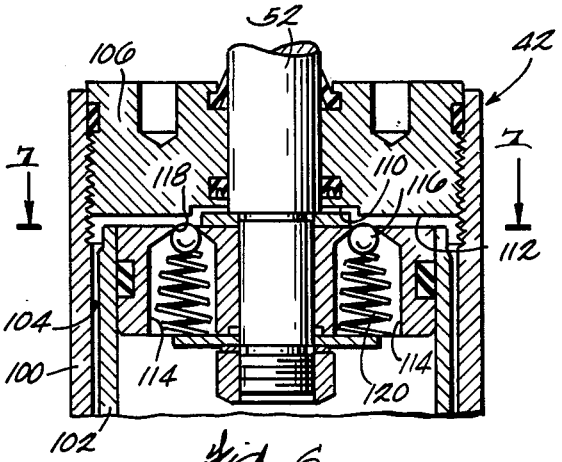
FIG. 6 is a partial view similar to FIG. 4 showing the piston topped out.
Figure 8:
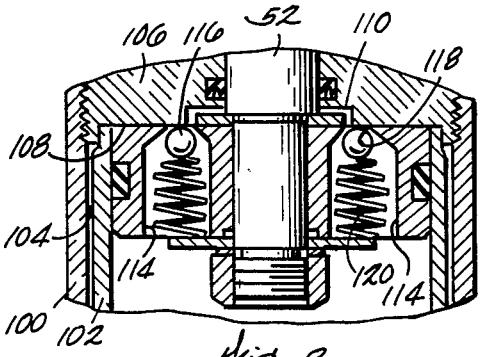
FIG. 8 is a view taken along line 8—8 in FIG. 7.

The hydraulic circuit includes means operable when the piston 46 tops out (when the piston 46 engages the cap 106) for opening the relief valves 56 in the piston 46 and thereby permitting communication between the lower cylinder chamber 50 and the passageway 76. When the piston 46 tops out, i.e., when the upper surface of the piston 46 engages the lower surface 108 of the cap 106, any balls 116 not aligned with the radial recesses 112 in the lower surface 108 of the cap 106 are unseated by the lower surface 108 of the cap 106. In the illustrated construction, as shown in FIG. 6, two of the balls 116 are aligned with the recesses 112. Therefore, when the piston 46- tops out, four of the balls 116 (the balls 116 not aligned with the recesses 112) are unseated, as shown in FIGS. 7 and 8. As shown in FIG. 8, the diameter of the annular recess 110 is such that when the balls 116 are unseated, the passageways 114 communicate with the annular recess 110, and therefore with the radial recesses 112, the space 104, and the passageway 76. Accordingly, when the piston 46 tops out, the lower cylinder chamber 50 communicates via the relief valves 56 with the passageway 76. This relieves pressure in the lower cylinder chamber 50.

The hydraulic circuit also includes a conventional thermal relief valve 84 and a conventional manual release valve 86 both communicating between the left end of the shuttle piston valve 64 and the reservoir 58. The thermal relief valve 84 prevents blocking of the hydraulic assembly as a result of extreme temperature changes, and the manual release valve 86 provides a means for relieving pressure in the hydraulic circuit if the hydraulic assembly fails. This permits manual lowering of the propulsion unit 30.

The hydraulic circuit also includes a conventional filter valve 88 communicating between the fourth passageway 76 and the reservoir 58. The filter valve 88 compensates for the different volumes of fluid displaced in the upper and lower cylinder chambers 48 and 50 due to the volume of the piston rod 52.

In the illustrated construction, the reservoir 58, pump 60, motor 62 and hydraulic circuit are all integrally connected to and located with the hydraulic assembly between the transom bracket arms 18 and between the transom 14 and the swivel bracket 26.

When the hydraulic assembly is fully contracted, i.e., when the volume of the lower cylinder chamber 50 is minimized, the swivel bracket 26 and propulsion unit 30 are in the operating position. Because the tilt pin 22 acts through the hydraulic assembly and the pin 54 to limit downward tilting movement of the swivel bracket 26, it is not necessary for the swivel bracket 26 to directly engage the tilt pin 22. Because the location of the tilt pin 22 relative to the transom bracket 16 determines the location of the hydraulic assembly relative to the transom bracket 16, and this in turn determines the location of the swivel bracket 26 relative to the transom bracket 16, variation of the location of the tilt pin 22 varies the trim or location of the operating position of the swivel bracket 26 and propulsion unit 30. Thus, the trim of the propulsion unit 30 can be varied by moving the tilt pin 22 to a different pair of aligned bores 24.

Various features and advantages of the invention are set forth in the following claims.

We claim:

1. A marine propulsion device comprising a transom bracket adapted to be fixedly mounted on the transom of a boat, said transom bracket having mounted thereon a tilt pin and including means permitting selective location of said tilt pin in a plurality of fixed positions relative to said transom bracket, a swivel bracket mounted on said transom bracket for pivotal movement relative thereto about a generally horizontal tilt axis, an extendible and contractable linkage including a first link having therein a bore receiving said tilt pin and a second link connected to said first link for telescopic movement relative thereto and connected to said swivel bracket for relative pivotal movement therebetween, means for selectively and alternatively extending and contracting said linkage, and a propulsion unit mounted on said swivel bracket for pivotal movement relative thereto about a generally vertical steering axis, and for common movement therewith about said tilt axis, said propulsion unit including a rotatably mounted propeller shaft, and a power head drivingly connected to said propeller shaft.

2. A marine propulsion device as set forth in claim 1 wherein said swivel bracket is movable between an operating position and a raised position, and wherein extension of said linkage moves said swivel bracket toward said raised position and contraction of said linkage moves said swivel bracket toward said operating position 3. A marine propulsion device as set forth in claim 1 wherein said means permitting selective location of said tilt pin includes means defining a plurality of passages extending through said transom bracket and having spaced, generally horizontal axes.

4. A marine propulsion device as set forth in claim 1 wherein said transom bracket includes a pair of horizontally spaced apart members extending generally vertically adjacent the transom and having upper and lower ends, wherein said tilt axis is located adjacent said upper ends, wherein said tilt pin is located adjacent said lower ends and extends between said members, and wherein said linkage is located between said members and between the transom and said swivel bracket.

5. A marine propulsion device as set forth in claim 4 wherein said means for extending and contracting said linkage is also located between said members and between the transom and said swivel bracket.

6. A marine propulsion device as set forth in claim 1 wherein said first and second links are included in a hydraulic cylinder and piston assembly, and wherein said means for extending and contracting said linkage includes means for supplying fluid to said hydraulic cylinder and piston assembly.

7. An assembly for mounting a marine propulsion unit on the transom of a boat, said assembly comprising a transom bracket adapted to be fixedly mounted on the transom, said transom bracket having mounted thereon a tilt pin and including means permitting selective location of said tilt pin in a plurality of fixed positions relative to said transom bracket, a swivel bracket mounted on said transom bracket for pivotal movement relative thereto about a generally horizontal tilt axis, and extendible and contractable linkage including a first link having therein a bore receiving said tilt pin and a second link connected to said first link for telescopic movement relative thereto and connected to said swivel bracket for relative pivotal movement therebetween and means for selectively ad alternatively extending and contracting said linkage.

8. An assembly as set forth in claim 7 wherein said swivel bracket is movable between an operating position and a raised position, and wherein extension of said linkage moves said swivel bracket toward said raised position and contraction of said linkage moves said swivel bracket toward said operating position.

9. An assembly as set forth in claim 7 wherein said means permitting selective location of said tilt pin includes means defining a plurality of passages extending through said transom bracket and having spaced, generally horizontal axes.

10. An assembly as set forth in claim 7 wherein said transom bracket includes a pair of horizontally spaced apart members extending generally vertically adjacent the transom and having upper and lower ends, wherein said tilt axis is located adjacent said upper ends, wherein said tilt pin is located adjacent said lower ends and extends between said members, and wherein said linkage is located between said members and between the transom and said swivel bracket.

11. An assembly as set forth in claim 10 wherein said means for extending and contracting said linkage is also located between said members and between the transom and said swivel bracket.

12. Assembly as set forth in claim 7 wherein said first and second links are included in a hydraulic cylinder and piston assembly, and wherein said means for extending and contracting said linkage includes means for supplying fluid to said hydraulic cylinder and piston assembly.

13. An assembly for mounting a marine propulsion unit on the transom of a boat, said assembly comprising a transom bracket adapted to be fixedly mounted on the transom, said transom bracket including a pair of horizontally spaced apart members extending generally vertically adjacent the transom and having upper and lower ends, said transom bracket having mounted thereon a tilt pin located adjacent said lower ends and extending between said members, and said transom bracket including means defining a plurality of passages extending through said transom bracket and having spaced, generally horizontal axes for permitting selective location of said tilt pin in a plurality of fixed positions relative to said transom bracket, a swivel bracket mounted on said transom bracket for pivotal movement relative thereto about a generally horizontal tilt axis located adjacent said upper ends, said swivel bracket being movable between an operating position and a raised position, an extendible and contractable hydraulic cylinder and piston assembly located between said members and between the transom and said swivel bracket so that extension of said assembly moves said swivel bracket toward said raised position and contraction of said assembly moves said swivel bracket toward said operating position, said assembly including a first link having therein a bore receiving said tilt pin and a second link connected to said first link for telescopic movement relative thereto and connected to said swivel bracket for relative pivotal movement therebetween, and means for selectively and alternatively extending and contracting said assembly, said extending and contracting means including means located between said members and between the transom and said swivel bracket for supplying fluid to said assembly.

14. A marine propulsion device comprising a transom bracket adapted to be fixedly mounted on the transom of a boat, said transom bracket having mounted thereon a tilt pin and including means permitting selective location of said tilt pin in a plurality of fixed positions relative to said transom bracket, a swivel bracket mounted on said transom bracket for pivotal movement relative thereto about a generally horizontal tilt axis, a propulsion unit mounted on said swivel bracket for pivotal movement relative thereto about a generally vertical steering axis and for common movement with said swivel bracket about said tilt axis, said propulsion unit including a rotatably mounted propeller shaft, and a power head drivingly connected to said propeller shaft, an extendible and contractable linkage including a first link having therein a bore receiving said tilt pin and a second link connected to said first link for telescopic movement relative thereto and connected to one of said swivel bracket and said propulsion unit for relative pivotal movement therebetween, and means for selectively and alternatively extending and contracting said linkage.

* * * * *